United States Patent [19]

Theurer

[11] 4,068,596

[45] Jan. 17, 1978

[54] MOBILE BALLAST TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 695,643

[22] Filed: June 14, 1976

[30] Foreign Application Priority Data

Aug. 25, 1975 Austria ..... 6564/75

[51] Int. Cl.[2] ..... E01B 27/17

[52] U.S. Cl. ..... 104/12; 104/1 R

[58] Field of Search ..... 104/1 R, 2, 7 R, 7 B, 104/8, 12; 33/1 Q, 144, 146, 287, 338

[56] References Cited

U.S. PATENT DOCUMENTS

| | | | |
|---|---|---|---|
| 3,744,428 | 7/1973 | Plasser et al. | 104/12 |
| 3,926,123 | 12/1975 | Plasser et al. | 104/12 X |
| 3,943,857 | 3/1976 | Theurer | 104/12 X |

FOREIGN PATENT DOCUMENTS

| | | | |
|---|---|---|---|
| 221,131 | 10/1961 | Austria | 104/2 |
| 1,205,020 | 9/1970 | United Kingdom | 33/287 |
| 226,219 | 1/1969 | U.S.S.R. | 33/1 Q |

*Primary Examiner*—Robert J. Spar
*Assistant Examiner*—Randolph A. Reese
*Attorney, Agent, or Firm*—Kurt Kelman

[57] ABSTRACT

A mobile ballast tamper comprises a vertically movable tamping head with vibratory tamping tools for tamping ballast under the track ties whereby the track is pressed upwardly. A counterpressure beam for holding the track in position against the upward pressure extends above each track rail in the direction thereof in the region of the tamping tools and has at least three points of engagement with the associated rail. Power-actuated drives are linked to ends of the counterpressure beams.

15 Claims, 3 Drawing Figures

MOBILE BALLAST TAMPER

Figure 1:
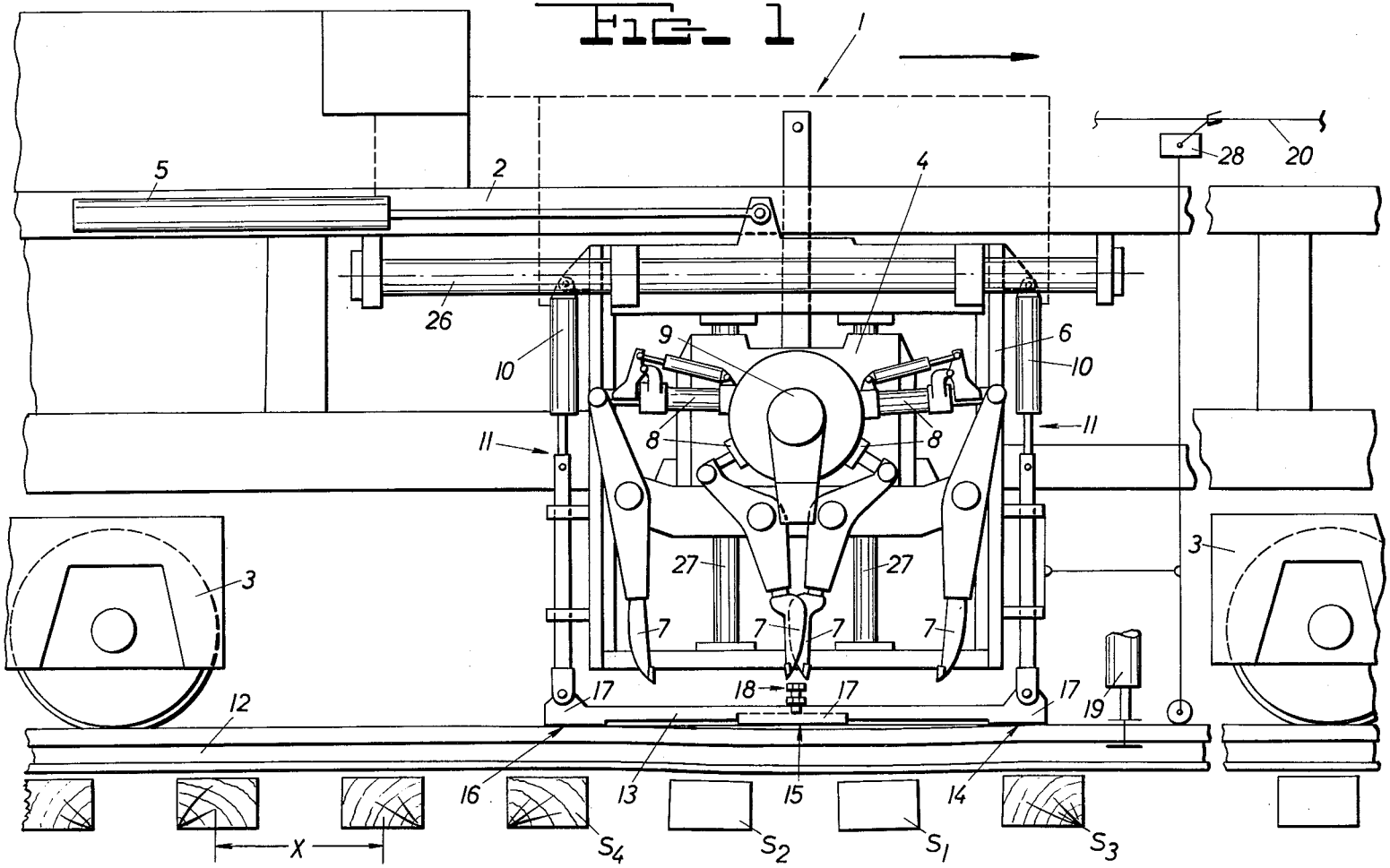

The present invention relates to improvements in a mobile machine for tamping ballast underneath a track consisting of two rails fastened to a plurality of spaced ties resting on the ballast, and more particularly to tamping machines which comprise a frame, a tamping unit vertically movably mounted on the frame and including a pair of vibratory tamping tools for tamping ballast under a respective one of the ties whereby the track is pressed upwardly, and means mounted on the frame for holding the track in position against the upward pressure to limit the upward movement of the track to a level controlled by a reference system.

In track leveling operations wherein the track is lifted and ballast is tamped under the lifted ties, the track is sometimes raised beyond the desired grade because of switching delays in the control circuit for the track lifting tools and/or excessive compaction of the tamped ballast, etc. This causes errors in the leveled track. Various proposals have been made to avoid such errors, i.e. to control the lifting operation accurately and dependably and/or to control undue ballast pressure on the track, but they tend to increase the operating time and/or to produce uneven, and sometimes, insufficient ballast compaction. In an effort to overcome these disadvantages, it has been proposed to hold the track in position against the upward tamping pressure so that the track cannot rise above the desired grade.

U.S. Pat. Nos. 3,744,428, dated July 10, 1973, and 3,910,195, dated Oct. 7, 1975, for example, disclose mobile ballast tamping machines with means mounted in the region of the tamping tools for holding the track in a fixed vertical position against upward pressure beyond a controlled grade. The disclosed track holding means comprise one or two closely spaced bearing rollers or rams pressed against the associated track rails by hydraulic motors to assume desired vertical positions controlled by a reference system in relation to which the track is leveled. These track holding devices have been successfully used in track leveling operations, but in some instances, particularly where several adjacent ties were tamped simultaneously, the locally limited transmission of downward pressure forces on the associated rails by the track holding devices of known structure has tended to produce irregularities in the track level.

It is the primary object of this invention to improve the structure of such track holding means and, more particularly, the arrangement of their drives and of their engagement with the associated rails, with a view to improving the pressure transmission to the rails and to prevent excessive rising of the track during a leveling operation extending over a long track section.

This and other objects are accomplished in accordance with the invention with a track holding means including a counterpressure beam having two ends and extending above each of the track rails in the direction thereof in the region of the tamping tools, the counterpressure beam having at least three points of engagement with the associated rail, and power actuated drives respectively linked to the counterpressure beam in the region of each beam end.

Such a track holding means will not only enable the tamping to proceed to a desired maximum degree of ballast compaction but the structure of the counterpressure beam with its three points of engagement and particularly its drives pressing against the ends of the elongated beam makes it possible to take into account the vertical position of the adjacent ties being tamped and to match the track level at the tamping station to that of the adjacent track section. This arrangement is of special advantage when the tamping is used as the sole track lifting force, i.e. when the track is leveled only by operation of the tamping tools without the use of track jacks. In addition, the track holding means of the present invention is also advantageous in an arrangement wherein one of the counterpressure beam ends is in engagement with an uncorrected track section rearwardly of a track jack which lifts the track to the desired grade. In this case, the ties are tamped while the track is held at the leveled position and the rails are straight, the elongated counterpressure beam preventing arcuate bending of the rails at the tamping station from the lifted section of the track frontward thereof towards the rear track section which has not yet been leveled. Furthermore, the counterpressure beam with its three points of engagement enables the level of the rails in the region of tamping to be matched to the vertical position of these points, thus enabling the rails to be suitably bent during the leveling operation, if desired, for instance at abutting rail ends. Also, if the counterpressure beam is used in connection with the tamping of ties positioned between tamped ties, the track level may be accurately matched to that of the adjacent tamped track since the beam will simultaneously serve as a reference, the two outer points of engagement being supported by the tamped track and defining the desired level and the vertical position of the intermediate point of engagement being fixed in relation thereto. Uneven spots along the track will no longer falsify the corrected track level since the rail will be engaged by the counterpressure beam at three points spaced apart in the direction of track elongation so that, if one of the points is out of line, the track will be at the exact grade at least in the region of the two other points of engagement.

It may be advantageous so to construct the counterpressure beam and/or to construct it of such material that the drives linked to the beam ends enable the beam to be slightly bent in its center region, i.e. to be somewhat resilient, so that the beam will be slightly convex when subjected to the downward pressure of the drives. This will take into account some play between the rail spikes and the rails so that the rails will be at the exact desired level when a train passes thereover.

Finally, since the elongated counterpressure beam does not contact the associated rail along its entire underside, but only at spaced points of engagement, friction between the beam and the rail is at a minimum.

Figure 2:
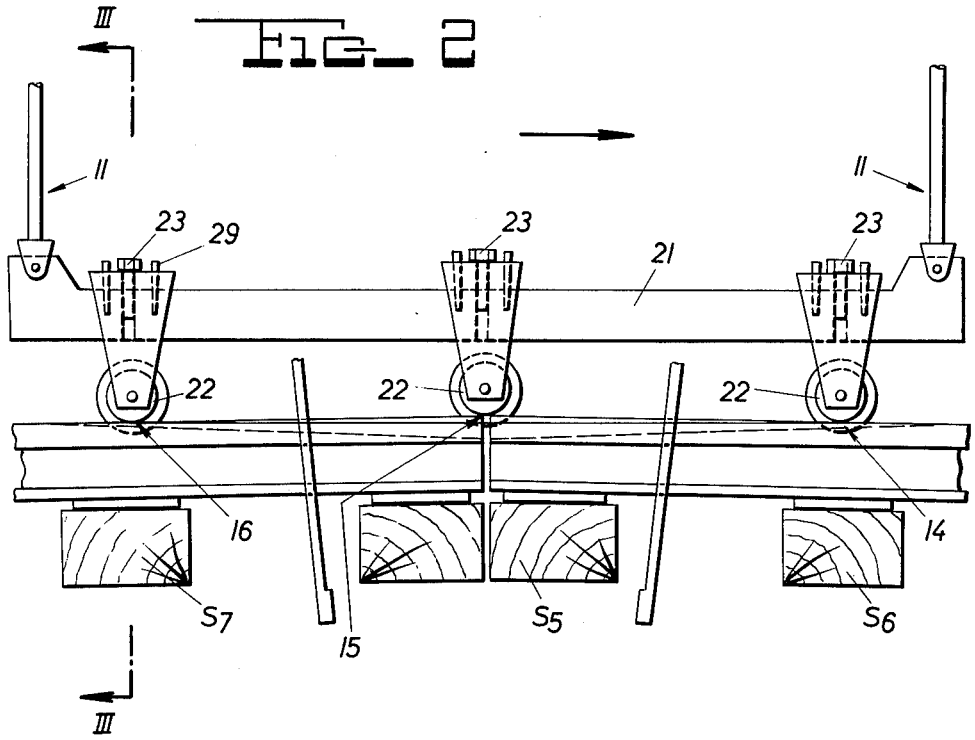
Figure 3:
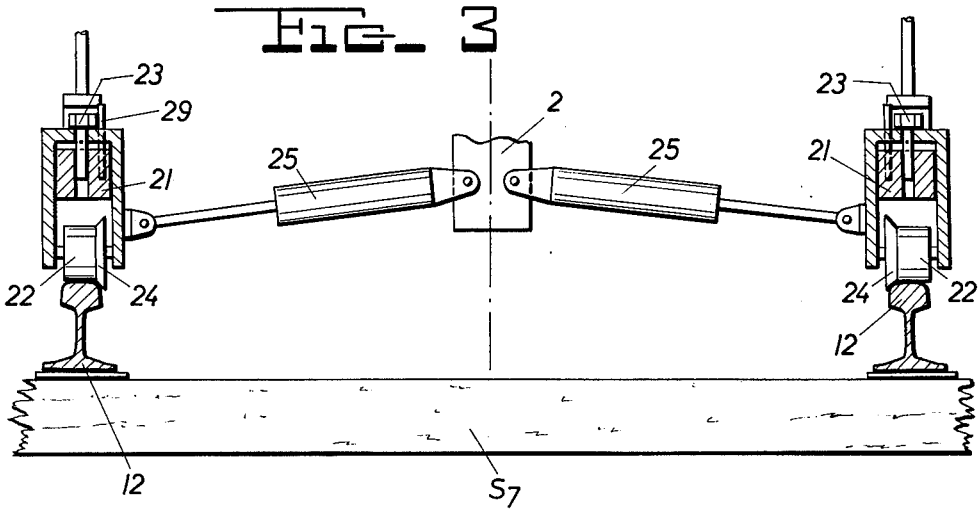

The above and other objects, advantages and features of the present invention will become more apparent from the following detailed description of certain now preferred embodiments thereof, taken in conjunction with the accompanying schematic drawing wherein FIG. 1 is a partial side elevational view of a mobile track tamper incorporating one embodiment of the track holding means according to this invention;

FIG. 2 is a side elevational view of another embodiment of the track holding means; and FIG. 3 is a vertical section along line III—III of FIG. 2.

Referring now to the drawing, wherein like reference numerals designate like parts functioning in a like manner in all figures, and first to FIG. 1, there is shown a mobile machine for tamping ballast underneath a track consisting of two rails 12, 12 fastened to a plurality of spaced ties $S_1$, $S_2$, $S_3$ and $S_4$ resting on ballast (not shown). Frame 2 of the machine is mounted on undercarriages 3, 3 for advancement along the track in the direction of the horizontal arrow shown in FIG. 1. Carrier frame 6 for tamping unit 4 is supported on guide beam 26 for movement in the direction of the track, the guide beam being fixed on machine frame 2 and hydraulic motor 5 being connected to the tamping unit carrier frame for moving the carrier frame in this direction. Tamping unit 4 is vertically movably mounted on support columns 27, 27 of carrier frame 6 and a conventional power-actuated drive is provided to move the tamping unit up and down. The tamping unit has at least one pair of vibratory tamping tools for tamping ballast under a respective one of the ties whereby the track is pressed upwardly, the illustrated unit including two pairs of vibratory tamping tools 7 spaced for simultaneously tamping two adjacent ties. The tamping unit further comprises means for actuating the tamping tools for imparting thereto a ballast tamping movement whereby the ballast is tamped under the respective ties, the illustrated actuating means including a central vibrating drive 9 and hydraulic motors 8 for reciprocating the tamping tools. Tamping units of this general type are well known and more fully disclosed and claimed, for instance, in U.S. Pat. No. 3,357,366, dated Dec. 12, 1967.

While one particular embodiment of tamping head has been illustrated, the present invention is not limited thereto and any tamping unit with a pair of vibratory tamping tools reciprocable to tamp ballast under a tie positioned between the tools may be used in combination with the track holding means of this invention. In the embodiment of the invention illustrated in FIG. 1, the track holding means includes counterpressure beam 13 extending above each track rail 12 in the direction thereof in the region of the tamping tools. The counterpressure beam has three points of engagement with the associated rail, two points of engagement 14, 16 at the ends of the beam and intermediate point of engagement 15 centered therebetween and between the pairs of tamping tools. Each point of engagement is constituted by bearing surface 17 projecting from beam 13 towards the associated rail and adapted for gliding engagement therewith. These bearing surfaces form rams pressing against the rail under the downward pressure of power-actuated drives 11 which are linked to the counterpressure beam in the region of each beam end. The illustrated drives are hydraulic motors 10 whose upper ends are mounted on tamping unit carrier frame 6.

This arrangement of the counterpressure beam on the tamping unit has the advantage that the vertical adjustment of the tamping tools and the track holding beam may be observed by the operator at the same time so as to exclude the possibility of damage to the beam during advancement of the machine from tamping station to tamping station. Since in most tampers, the tamping tools may also be moved laterally, i.e. transversely to the track, to center the tools over the rails, the mounting of the counterpressure beam on the tamping unit will automatically center the beams over the associated rails at the same time that the tamping tools are so centered, thus assuring proper alignment of the beams and rails in track curves, for example. The longitudinal movement of the tamping unit with the counterpressure beams is particularly useful in the illustrated arrangement for simultaneous tamping of several adjacent ties since this enables the end points of engagement 14 and 16 to be positioned in alignment with the adjacent, partially tamped ties while the intermediate point of engagement 15 is centered in the region of the ties to be tamped.

Where the tamping unit has a pair of vibratory tamping tools for the tamping of a single tie at each tamping station, it will be useful for the length of counterpressure beam 13 to be equal to the sum of at least two spaces X between adjacent ties, each space being measured from longitudinal center line to longitudinal center line of the ties, as shown in FIG. 1. In this case, intermediate point of engagement 15 is centered between the tamping tools of the pair. In this manner, the leveling of the rails during the leveling and tamping operation is clearly limited to the region of the tamped ties.

On the other hand, if the tamping unit is of the illustrated type including two pairs of vibratory tamping tools spaced for simultaneous tamping of two adjacent ties $S_1$ and $S_2$, the length of the counterpressure beam is preferably equal to the sum of at least three such spaces between adjacent ties and the intermediate point of engagement is centered between the pairs of tamping tools. In this manner, the end points of engagement of the counterpressure beam will be in alignment with ties $S_3$ and $S_4$ delimiting the tamping station which encompasses the two adjacent ties $S_1$ and $S_2$. Particularly if ties $S_3$ and $S_4$ have previously been tamped and thus constitute the desired track level, this arrangement will assure accurate matching of the track level in the tamping station with the desired track level, i.e. the counterpressure beam will prevent the track rails from rising beyond this level under the upward tamping pressure and assure an even and continuous level along the entire track section being surfaced. Such an even level has been difficult to obtain particularly with tamping machines which are designed for the simultaneous tamping of several adjacent ties because of the increased upward tamping pressure produced by more than one pair of tamping tools. Thus, the elongated counterpressure beam arranged in the hereinabove described manner and as illustrated therein has the added advantage of assuring an accurately even track level over a long section of track.

The type of tamping illustrated in FIG. 1, wherein the cross hatched ties have been tamped before ties $S_1$ and $S_2$ are tamped, i.e. successive tamping stations including two ties are located between previously tamped ties, is known, for instance, from U.S. Pat. No. 3,744,428 wherein a tandem tamper is disclosed. Such a tamper includes a tamping unit preceding tamping unit 4, the two tamping units being coordinated to operate in tandem as the machine advances along a track section to be surfaced. When used in this arrangement, the counterpressure beam functions simultaneously as a level reference at the tamping station $S_1$, $S_2$.

While the counterpressure beam is substantially rigid, it may be so constructed as to yield slightly at its center under the upward pressure of tamping so that the rails will be raised a little above the level of end points 14 and 16 at intermediate point 15. Alternatively to the yielding of the beam at its center, the intermediate point of engagement may be a little higher than the end points.

The illustrated bearing surfaces 17 in gliding contact with the rails will enable the track holding rams to contact the rails with a minimum of friction during the intermittent advancement of the machine and without causing damage to the upper surfaces of the rail heads on which the train wheels run. The bearing surfaces of the rams may be configured to contact not only the upper surfaces of the rail heads but also their inner flanks or sides. If the counterpressure beams are laterally adjustable in a manner not shown, for instance by mounting the tamping unit carrier frame on the machine frame not only for longitudinal but also for lateral movement, as is well known in tampers, it is possible to use such a counterpressure beam not only for holding the track rails in a leveled position but also in a lined position.

The illustrated machine is a combined leveling and tamping machine of the well known type including a reference system with reference line 20 which cooperates with a control signal emitter 28 which runs on the track to determine the level in relation to the reference line. The machine frame also carries track lifting means 19, the control signal from emitter 28 controlling the actuating means for the tamping tools as well as the drives for the counterpressure beam and the track lifting means, all in a well known manner forming no part of the present invention. In parts of the surfaced track section which require little raising to the desired level, the tamping pressure may suffice to adjust the track to this level. Larger errors will be corrected with the assistance of the track lifting jack 19.

Such a control will provide not only very accurate and even leveling but will also make it possible to hold the tamping pressure to a desired force, this assuring even compaction of the ballast along the entire surfaced track section covered by the intermittently advancing machine. The cooperation of the counterpressure beam and the track jacks with the reference system makes it possible to adjust the beam to the desired level and to jack an uncorrected track section to this level, thus making certain that the ends of the beam are always in engagement with a leveled track section. In this connection, it would be possible to mount the control signal emitter which cooperates with the reference line directly on the counterpressure beam, particularly in the end regions thereof where the drives for the beams apply their downward pressure. In the illustrated embodiment, control signal emitter 28 is mounted directly on the rail 12 for movement relative to beam 13. If only the track jacks are under the control of the reference system and not beam drives 11, the track will be jacked to the desired level so that the ends of beam 13 will be at this level in engagement with the track rails, thus serving as reference for the leveling of the track at the tamping station.

FIGS. 2 and 3 illustrate another embodiment of track holding means according to the present invention. Counterpressure beam 21 has a length equal to the sum of at least two spaces between adjacent ties, FIG. 2 showing double-tie $S_5$ flanked by ties $S_6$ and $S_7$, and the tamping unit having a pair of vibratory tamping tools arranged for tamping the double-tie. In this embodiment, the counterpressure beam points of engagement with the associated rails are constituted by flanged wheels 22 mounted on the beam and adapted for rolling engagement with the associated rail. Flange 24 of wheels 22 is arranged for engagement with the inside of the associated rail, as shown in FIG. 3, and hydraulic motors 25 are linked to machine frame 2 and the brackets holding the flanged wheels on beam 21 for pressing the wheel flanges against the inside of the rail heads. This guidance of the counterpressure beam on the rails assures a particularly friction-free contact and involves a minimum of wear of the pressure points. It also makes it possible to use the counterpressure beam for lining in the manner explained hereinabove.

As shown in FIG. 2, the tamping station is at a location of abutting rail ends which are supported by a double tie. Since the abutting rail ends tend to be depressed by the ensuing train traffic rolling over the leveled track (see broken lines), it is desirable to lift them during the leveling operation beyond the desired level of the entire track section, i.e. to bend the rails slightly upwardly at this point, as shown in full lines, the track level being indicated by the straight thin line connecting end points 14 and 16. For this purpose, intermediate rail engagement wheel 22 is vertically adjustably mounted in its bracket with respect to counterpressure beam 21. This makes it possible to adjust the vertical position of this wheel to the desired level determining the level of the abutting rail ends at double tie $S_5$. The illustrated vertical adjustment is effected by a mechanical drive, i.e. spindle-and-nut drive 23, guides 29 holding the mounting bracket for the flanged wheel in aligned position to avoid twisting of the wheel during vertical adjustment.

In the illustrated embodiment, all three flanged rail engagement wheels are vertically adjustable on beam 21 by set screws 23. The vertical adjustability of the rail engagement points makes it possible to adapt their levels to various operating conditions and the length of the counterpressure beam. Particularly when the beam extends over a plurality of cribs, slightly raising the intermediate rail engagement point over the level of the end points will have the end effect that the entire stretch of track has an even level.

Where the track is pressed upwardly during tamping and the counterpressure beam holds the track in position against this upward pressure, the tamped ballast will attain a desired density providing a solid support for the leveled track. Where the leveling operation also includes jacking of the track, it will be advantageous to discontinue operation of jacks 19 shortly before the operation of tamping tools 7 is terminated, for instance one or two seconds prior thereto, so that any residual raising of the track to the desired level is effected solely by the upwardly pressing tamped ballast. This will increase the compaction of the ballast. However, if the general ballast condition of the track is good and relatively little tamping is required during the surfacing operation, tamping and jacking may be terminated simultaneously while the track is held at the desired level against upward movement. The control for the operation of drives 11 may be so arranged that these drives will hold the counterpressure beam in a fixed position against the rails until the tamping tools have been vertically moved out of the ballast and jacking has been completed so that no further movements will disturb the leveled position of the track.

While this has not been illustrated, it is possible to mount the rail engagement points not only for vertical but also for lateral adjustment on the counterpressure beam and, for this purpose, it is possible to use the same adjustment means as for the vertical adjustment. While a mechanical adjustment drive has been illustrated, such adjustment means may obviously also be pressure fluid operated devices.

What is claimed is:

1. A mobile machine for tamping ballast underneath a track consisting of two rails fastened to a plurality of spaced ties resting on the ballast, the machine comprising 1. a frame
2. a tamping unit vertically movably mounted on the frame, the unit including
   a. a pair of vibratory tamping tools for tamping ballast under a respective one of the ties whereby the track is pressed upwardly, and
3. means mounted on the frame for holding the track in position against the upward pressure, the track holding means including
   a. a counterpressure beam having two ends and extending in a vertical plane above each of the track rails in the direction thereof in the operating area of the tamping tools, the counterpressure beam having at least three points of engagement with and downward pressure against, the associated rail, and
   b. power-actuated drives, a respective one of the drives being linked to the counterpressure beam in the region of each one of the beam ends for exerting downward pressure upon the beam ends and the beam ends engaging track rail points having a desired level.

2. The mobile ballast tamping machine of claim 1, wherein the power-actuated drives are hydraulic motors.

3. The mobile ballast tamping machine of claim 2, further comprising means for lateral adjustment of the counterpressure beam.

4. The mobile ballast tamping machine of claim 1, wherein the tamping unit comprises a carrier frame for the tamping tools and the power-actuated drives are mounted on the tamping unit carrier frame.

5. The mobile ballast tamping machine of claim 1, wherein the length of the counterpressure beam is equal to the sum of at least two spaces between adjacent ties, each space being measured from longitudinal center line to longitudinal center line of the ties, and an intermediate one of the points of engagement is centered between the tamping tools.

6. The mobile ballast tamping machine of claim 1, wherein the tamping unit includes two of said pairs of vibratory tamping tools, the pairs being spaced for simultaneously tamping two adjacent ones of the ties, the length of the counterpressure beam is equal to the sum of at least three spaces between adjacent ties, each space being measured from longitudinal center line to longitudinal center line of the ties, and an intermediate one of the points of engagement is centered between the pairs of tamping tools.

7. The mobile ballast tamping machine of claim 1, wherein each point of engagement is constituted by a bearing surface projecting from the beam towards the associated rail and adapted for gliding engagement therewith.

8. The mobile ballast tamping machine of claim 1, wherein each point of engagement is constituted by a flanged wheel mounted on the beam and adapted for rolling engagement with the associated rail.

9. The mobile ballast tamping machine of claim 8, wherein the flange of the wheel is arranged for engagement with the inside of the associated rail, and further comprising means for pressing the wheel flange against the inside of the rail.

10. The mobile ballast tamping machine of claim 1, further comprising means for vertically adjusting at least an intermediate one of the points of engagement with respect to the counterpressure beam.

11. The mobile ballast tamping machine of claim 10, wherein the adjusting means comprises a mechanical drive.

12. The mobile ballast tamping machine of claim 1, wherein the tamping unit comprises a carrier frame for the tamping tools, the power-actuated drives are mounted on the tamping unit carrier frame, and further comprising guide means supporting the carrier frame with the tamping tools and drives for movement in the direction of the track.

13. The mobile ballast tamping machine of claim 12, further comprising power-actuated drive means for moving the carrier frame along the guide means in said direction.

14. The mobile ballast tamping machine of claim 1, further comprising means for actuating the tamping tools for imparting thereto a ballast tamping movement whereby the ballast is tamped under the respective tie, and a control for the actuating means, the actuating means being responsive to the control for determining a desired tamping pressure exerted by the moved tamping tools, the control including a reference system having a control signal emitter.

15. The mobile ballast tamping machine of claim 14, further comprising a track lifting means responsive to the control.

* * * * *